US005331777A

United States Patent [19]

Chi-Yuan

[11] Patent Number: 5,331,777

[45] Date of Patent: Jul. 26, 1994

[54] COLLAPSIBLE FOLDING FRAME ASSEMBLY FOR A COLLAPSIBLE FOLDING VEHICLE BARN

[76] Inventor: Huang Chi-Yuan, 81-1, Mei-Kuang St., Tao-Yen City, Tao-Yen Hsien, Taiwan

[21] Appl. No.: 51,754

[22] Filed: Apr. 26, 1993

[51] Int. Cl.[5] ..... E04B 7/16; E04H 15/48

[52] U.S. Cl. ..... 52/64; 135/103; 135/107

[58] Field of Search ..... 52/63, 64, 109, 107, 52/103; 135/107, 103; 403/326, 330, 327, 376, 377

[56] References Cited

U.S. PATENT DOCUMENTS

| | | | |
|---|---|---|---|
| 2,473,388 | 6/1949 | Rambo | 182/178 |
| 3,064,667 | 11/1962 | Marino | 135/103 |
| 3,492,772 | 2/1970 | Bergman | 403/329 |
| 3,729,890 | 5/1973 | Yamamoto et al. | 135/110 |
| 4,247,216 | 1/1981 | Pansini | 403/329 |
| 4,667,692 | 5/1987 | Tury et al. | 53/109 |
| 4,844,109 | 7/1989 | Navarro | 52/109 |

*Primary Examiner*—James L. Ridgill, Jr.

[57] ABSTRACT

A collapsible folding frame assembly for a collapsible folding vehicle barn including two collapsible folding frame units vertically disposed at two opposite sides, and a bridge frame unit connected between the two collapsible folding frame units at the top, each collapsible folding frame being consisted of a plurality of roller-supported upright tubes connected by folding cross frames, the bridge frame being consisted of a plurality of bridge frames, each bridge frame being consisted of two tubes connected by engaging a spring-supported pin on one tube into a pin hole on the other tube.

1 Claim, 4 Drawing Sheets

COLLAPSIBLE FOLDING FRAME ASSEMBLY FOR A COLLAPSIBLE FOLDING VEHICLE BARN

BACKGROUND OF THE INVENTION

The present invention relates to a collapsible folding frame assembly for a collapsible folding vehicle barn which can be collapsed and then dismantled into three separate units to reduce its space occupation when not in use.

In recent years, motor vehicles have become more and more popular everywhere in the world. As a result of the continuous increasing of motor vehicles, the demand for motor vehicle barns is strong. There are mobile vehicle barns designed for storing motor vehicles and protecting them against the weather which can be moved from place to place and dismantled when not in use. However, these mobile vehicle barns are complicated to assemble and dismantle.

SUMMARY OF THE INVENTION

One object of the present invention is to provide a collapsible folding frame assembly for a collapsible folding vehicle barn which can be conveniently set up into the operative condition. Another object of the present invention is to provide a collapsible folding frame assembly for a collapsible folding vehicle barn which can be conveniently collapsed and then dismantled into separate units to reduce its space occupation for delivery.

According to the preferred embodiment of the present invention, the collapsible folding frame assembly is comprised of two collapsible folding frame units symmetrically and vertically disposed at two opposite sides, and a bridge frame unit connected between the collapsible folding frame units at the top. The bridge frame unit is comprised of a plurality of bridge frames, each bridge frame being consisted of two tubes connected through a plug joint. Each collapsible folding frame unit is comprised of roller supported upright tubes connected by folding cross frames and slide connectors. The bridge frames are respectively connected to the upright tubes through plug joints. Therefore, the collapsible folding frame units can be extended out into the operative condition and then received back into the collapsed non-operative condition.

DETAILED DESCRIPTION OF THE PREFERRED EMBODIMENT

Figure 1:
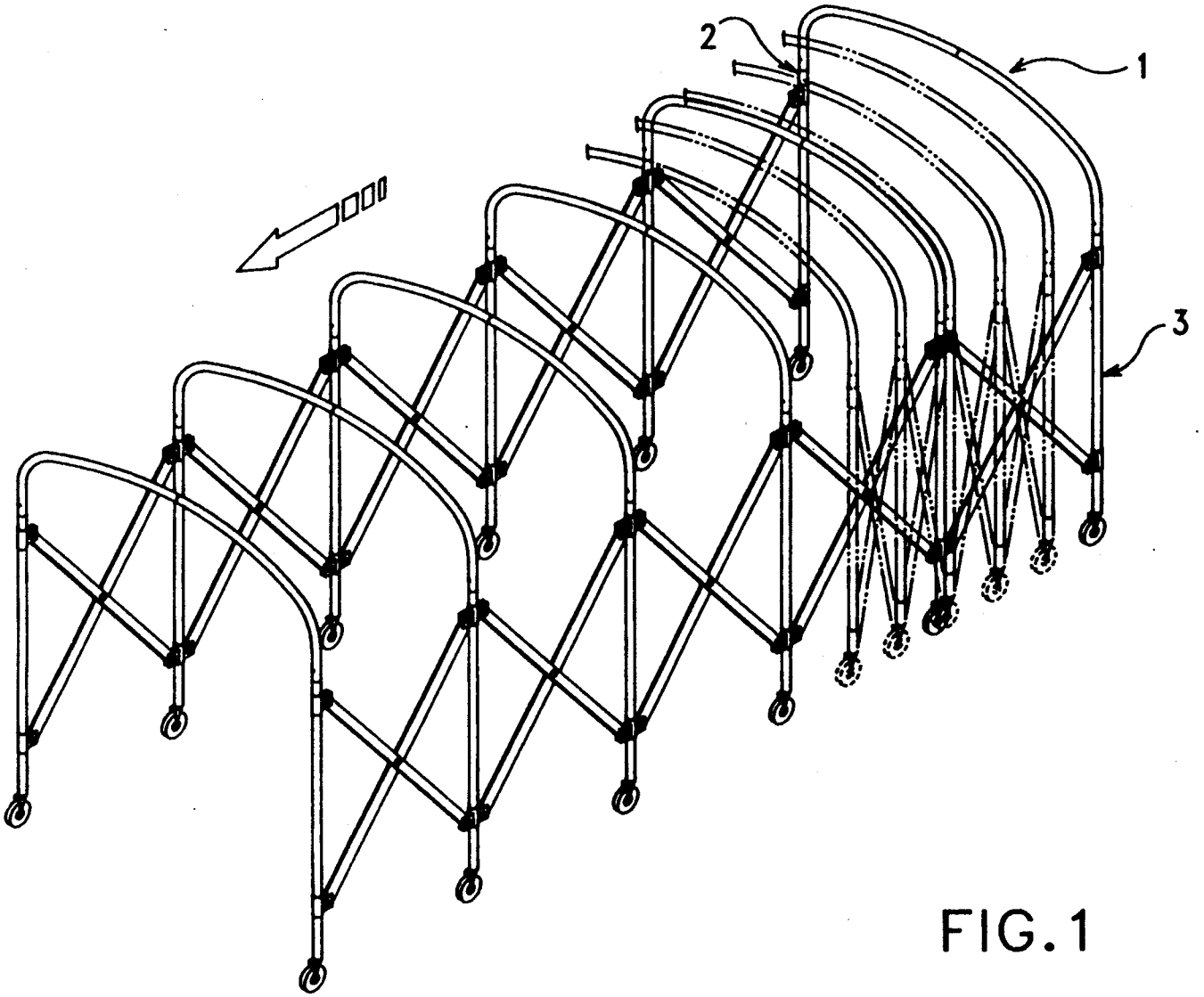
FIG. 1 is a perspective view of a collapsible folding frame assembly of the present invention when spread out.
Figure 2:
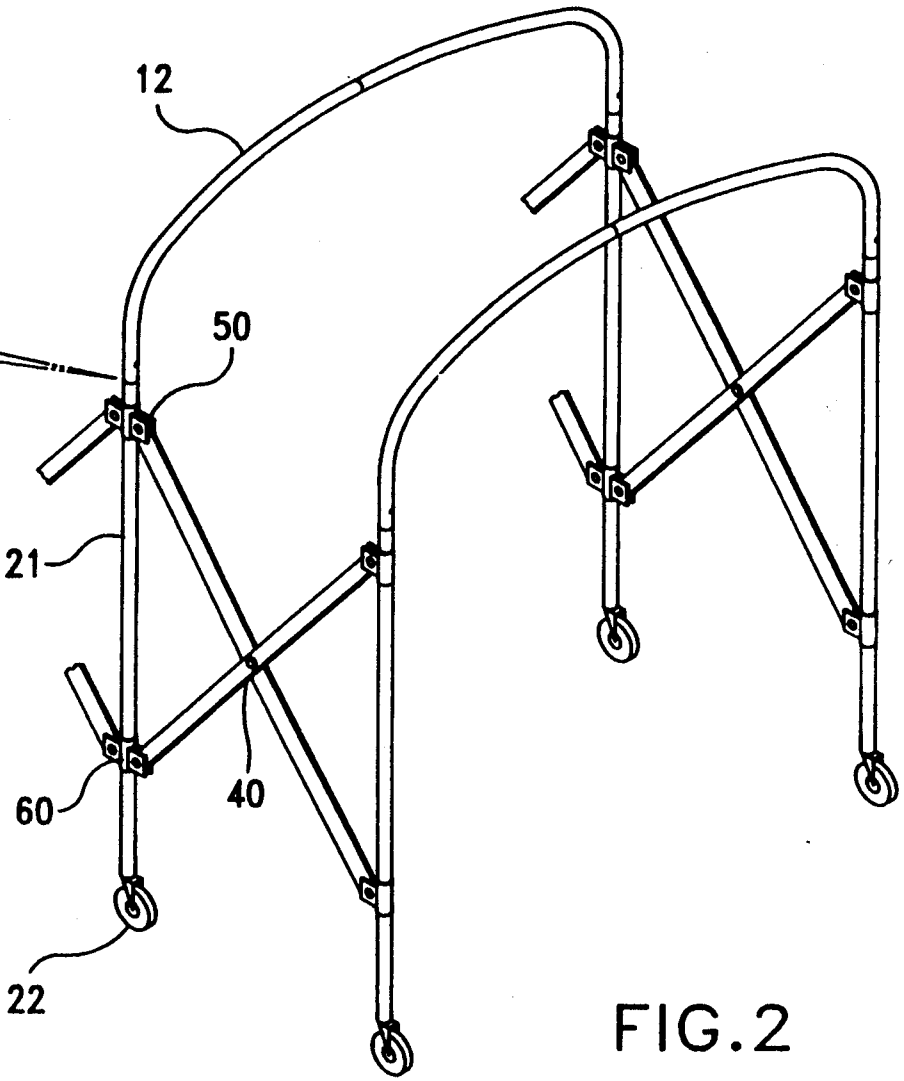
FIG. 2 and 2A are partial perspective views showing the connection between two adjacent upright tubes and the connection between either upright tube and the respective bridge frame.
Figure 2A:
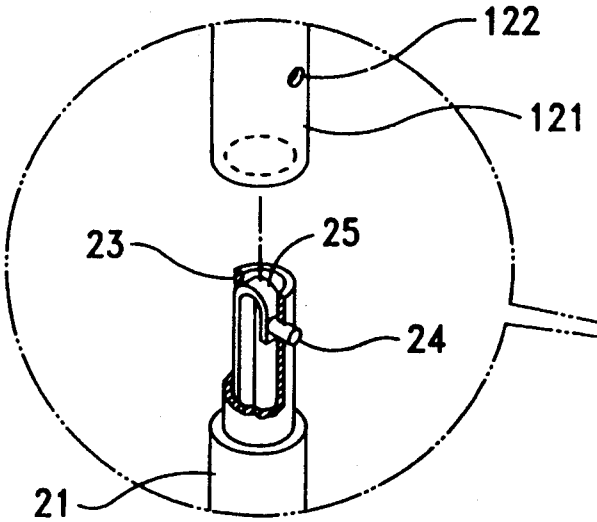
Figures 3, 3A:
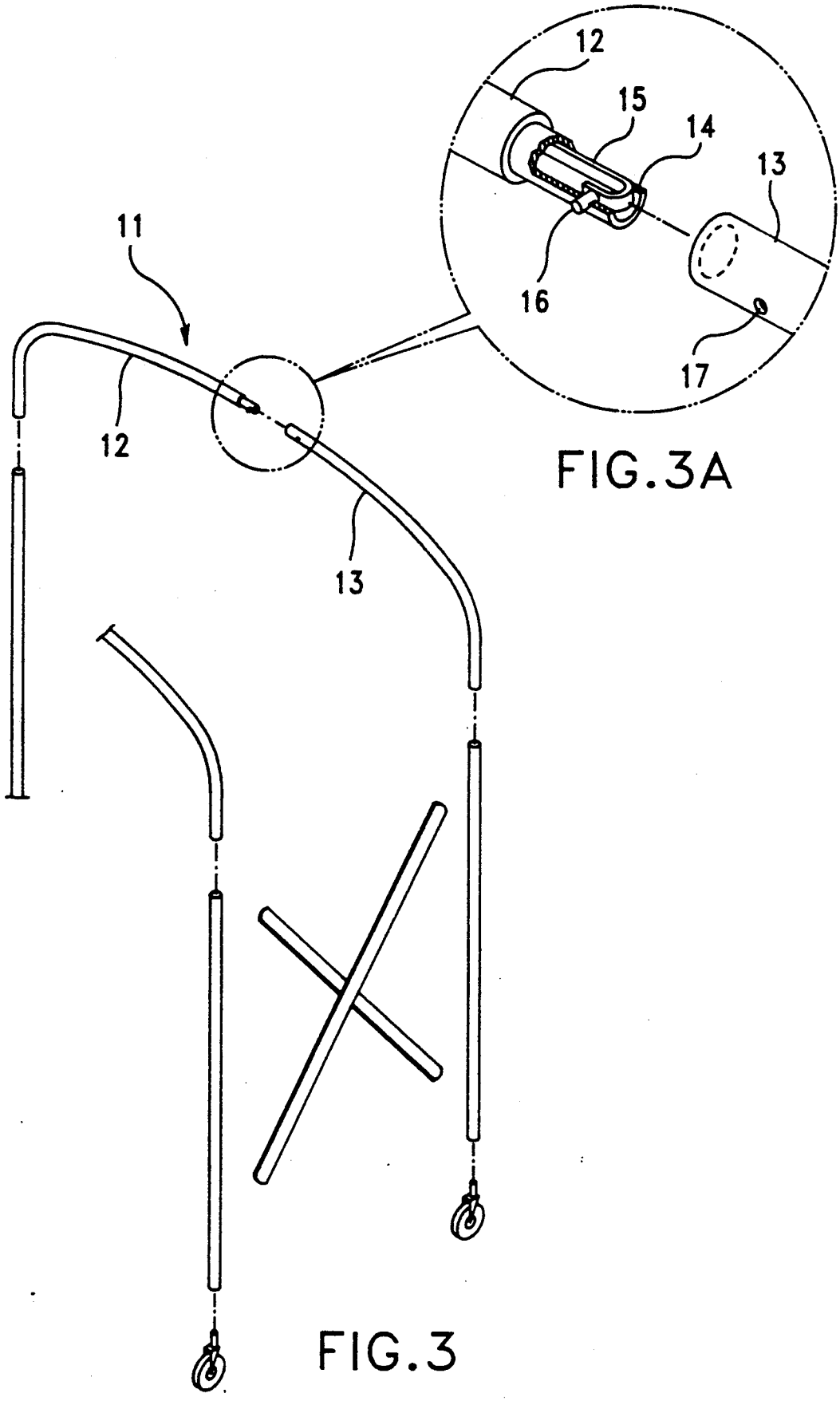
FIG. 3 and 3A illustrate the connection between the first and second tubes of each bridge frame.

Referring to FIGS. 1, 2, 2A, 3, 3A, and 4, 4A a collapsible folding frame assembly for a collapsible folding vehicle barn in accordance with the present invention is generally comprised of a first collapsible folding frame unit 2 at one side, a second collapsible folding frame unit 3 at an opposite side, and a bridge frame unit 1 connected between the first and second collapsible folding frame unit at the top.

The bridge frame unit 1 is comprised of a plurality of bridge frames 11 respectively made in the shape of a flat arch and consisted of two opposing tubes 12;13 connected together. One tube of each bridge frame 11, namely, the first tube 12 has one end terminated to a reduced cylindrical extension tube 14 inserted with a leaf spring 15, which leaf spring 15 is fastened with a pin 16 extended out of the reduced cylindrical extension tube 14 in a radial direction through a side hole (not shown) thereon, and an opposite end terminated to an angle tube 121 having a pin hole 121 in a radial direction. The other tube of each bridge frame 11, namely, the second tube 13 has one end made with a pin hole 17 at a location corresponding to the pin 16 on the reduced cylindrical extension tube 14, and an opposite end terminated to an angle tube 131 having a pin hole 132 in a radial direction. The first and second tubes 12;13 are connected into a bridge frame 11 by pressing down the pin 16 and then inserting the reduced cylindrical extension tube 14 of the first tube 12 into the second tube 13 for permitting the pin 16 to be engaged into the pin hole 17. The first and second tubes 12;13 can be conveniently detached from each other by pressing down the pin 16.

The first and second collapsible folding frame units 2,3 are symmetrical, comprising each a plurality of upright tubes 21 or 31 respectively connected by folding cross frames 40 and slide connectors 50;60. The slide connectors 50;60 having each side a connecting terminal respectively are respectively and slidably mounted on each upright tube 21 or 31 at different elevations. The four ends of each folding cross frame 40 are pivotally connected to a cordinate connecting terminal of respective slide connectors 50;60 so that the upright cubes 21 or 31 can be spread out and then folded up into a collapsed condition. Each upright tube 21 or 31 has a bottom end coupled with a roller 22, and a top end terminated to a reduced cylindrical extension tube 23 inserted with a leaf spring 25, which leaf spring 25 is fastened with a pin 24 extended out of the reduced cylindrical extension tube 23 in a radial direction through a side hole (not shown) thereof. By inserting the reduced cylindrical extension tube 23 of either upright tube 21 or 31 into the angle tube 121 or 131 on the first tube 12 or second tube 13 of the respective bridge frame 11 for permitting the respective pin 24 to be engaged into the respective pin hole 121 or 131, the bridge frame unit 1 is connected between the first and second collapsible folding frame units 2;3 at the top. As the collapsible folding frame assembly is set up and spread out, a canvas cover or suitable covering cloth is fastened to the collapsible folding frame assembly by magic tapes (velcro) or suitable fastening means to protect against weather.

Figure 4A:
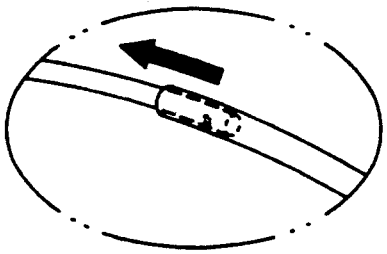
FIG. 4 and 4A are perspective dismantled views showing the collapsible folding frame assembly detached into three separate units.
Figure 4:
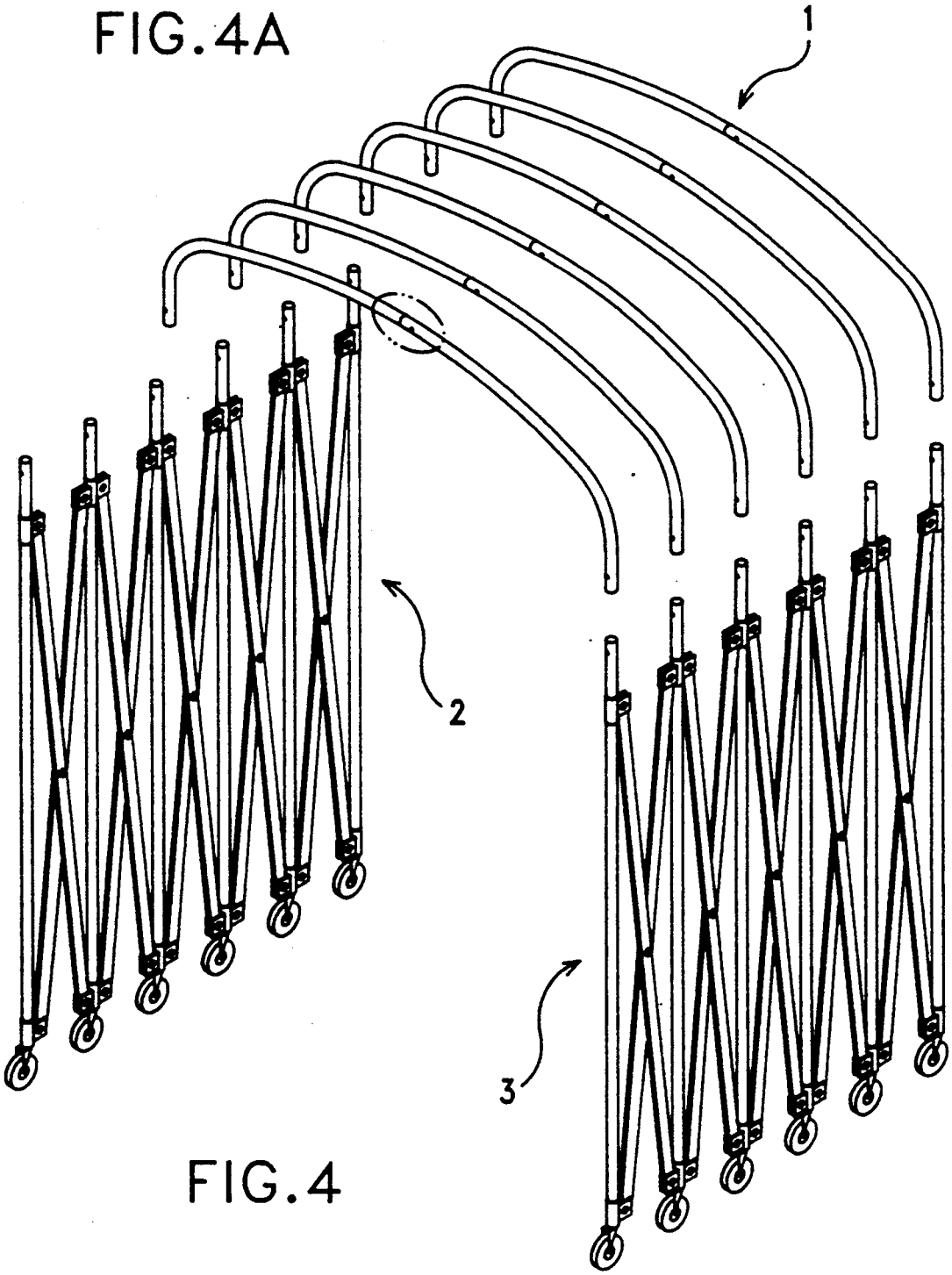

Referring to FIG. 4 and 4A, when not in use, the collapsible folding frame assembly can be collapsed and then dismantled into the bridge frame unit 1, the first collapsible folding frame unit 2, and the second collapsible folding frame unit 3, to reduce space occupation. Each bridge frame 11 of the bridge frame unit 1 can also be detached into the first tube 12 and the second tube 13.

What is claimed is:

1. A collapsible folding frame assembly for a collapsible folding vehicle barn comprising two collapsible folding frame units vertically disposed at two opposite sides, and a bridge frame unit connected between said two collapsible folding frame units at the top, each collapsible folding frame unit comprising a plurality of upright tubes respectively connected by folding cross frames and slide connectors, said slide connectors being respectively and slidably mounted on each upright tube at different elevations, each folding cross frame having four ends pivotally connected to a coordinate connecting terminal of respective slide connectors, each upright tube having a bottom end coupled with a roller and a top end terminated to a reduced cylindrical extension tube having a spring supported side pin for connecting said bridge frame unit, said bridge frame unit comprising a plurality of bridge frames respectively connected to either upright tube, each bridge frame being consisted of a first tube and a second tube, said first tube having one end terminated a reduced cylindrical extension tube having a spring supported side pin releasably engaged into a pin hole on one end of said second tube, said first and second tube having each an opposite end made with a side pin hole into which the spring-supported pin on either upright tube engages.

* * * * *